US006135202A

United States Patent [19]

Koshak

[11] Patent Number: 6,135,202

[45] Date of Patent: Oct. 24, 2000

[54] APPARATUS FOR RUNNING JOINTED TUBULARS UTILIZING A COILED TUBING INJECTOR

[75] Inventor: Warren E. Koshak, Destrehan, La.

[73] Assignee: Halliburton Energy Services, Inc., Duncan, Okla.

[21] Appl. No.: 09/013,793

[22] Filed: Jan. 26, 1998

[51] Int. Cl.[7] ..... E21B 19/06

[52] U.S. Cl. ..... 166/77.1; 166/379; 166/380; 166/381

[58] Field of Search ..... 166/381, 77.1, 166/77.2, 377, 379, 380

[56] References Cited

U.S. PATENT DOCUMENTS

| | | | |
|---|---|---|---|
| 2,679,924 | 6/1954 | Powell | 202/227 |
| 3,258,110 | 6/1966 | Pilcher | 198/162 |
| 3,285,485 | 11/1966 | Slator | 226/172 |
| 3,559,905 | 2/1971 | Palynchuk | 242/54 |
| 3,658,270 | 4/1972 | Slator et al. | 242/54 |
| 3,754,474 | 8/1973 | Palynchuk | 74/162 |
| 3,757,858 | 9/1973 | Davis et al. | 166/77 |
| 4,251,176 | 2/1981 | Sizer et al. | 414/22 |
| 4,515,220 | 5/1985 | Sizer et al. | 166/384 |
| 4,585,061 | 4/1986 | Lyons, Jr., et al. | 166/77 |
| 4,655,291 | 4/1987 | Cox | 166/385 |
| 5,094,340 | 3/1992 | Avakov | 198/626.1 |
| 5,188,174 | 2/1993 | Anderson, Jr., et al. | 166/77 |
| 5,738,173 | 4/1998 | Burge et al. | 166/385 |
| 5,850,874 | 12/1998 | Burge et al. | 166/77.3 |

*Primary Examiner*—William Neuder
*Assistant Examiner*—Zakiya Walker
*Attorney, Agent, or Firm*—Stephen R. Christian; Anthony L. Rahhal

[57] ABSTRACT

A lift sub for removing jointed tubulars from a wellbore and for inserting jointed tubulars is provided. A coiled tubing injector having opposed gripper chains engages the lift sub and may be actuated to raise or lower the lift sub. The lift sub has a connecting means at the lower end thereof for connecting the lift sub to a jointed tubular. The coiled tubing injector can be actuated to raise or lower the jointed tubular so as to remove the jointed tubular from the wellbore or to insert it therein.

19 Claims, 6 Drawing Sheets

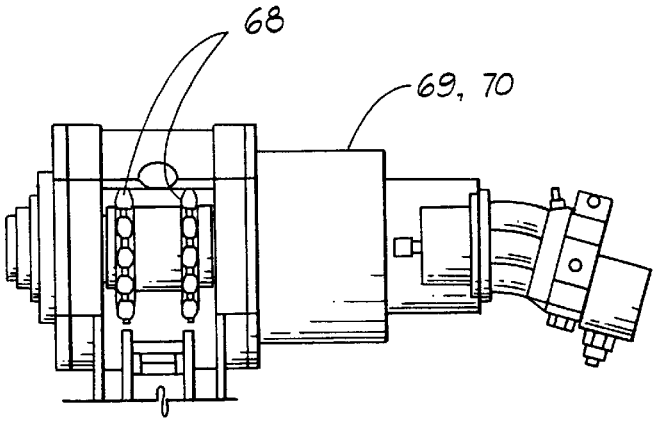
FIG. 5
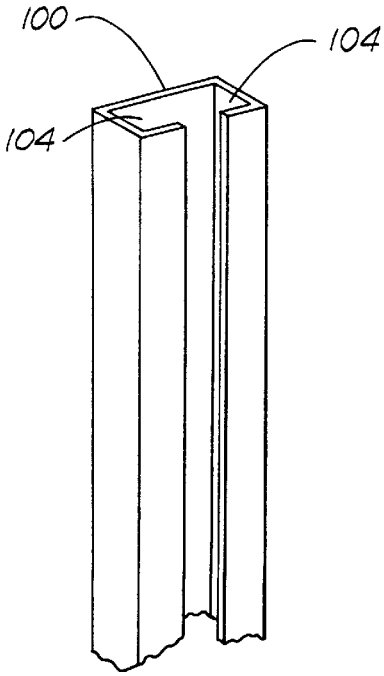
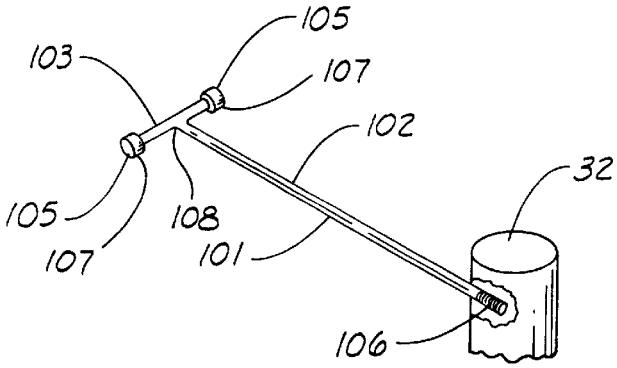
FIG. 8
FIG. 7

APPARATUS FOR RUNNING JOINTED TUBULARS UTILIZING A COILED TUBING INJECTOR

BACKGROUND OF THE INVENTION

This invention relates to an apparatus for injecting and/or withdrawing jointed tubulars, and more particularly to coiled tubing injector with a lift sub adapted to be connected to jointed tubulars.

Coiled or reeled tubing has been run into wells with coiled tubing injectors for many years for performing certain downhole operations, such as, for instance, washing out sand bridges, circulating treating fluids, setting downhole tools, cleaning the walls of well pipes, conducting production fluids or lift gas, and a number of other similar remedial or production operations. Thus, opportunities exist to utilize coiled tubing technology in the drilling, completion and workover of new wells and in re-entries. In many instances, production tubulars must be pulled prior to proceeding with coiled tubing operations. In some cases, small casing sizes must also be removed or, in the case of drilling, run into the newly drilled section of the wellbore.

Typically, jointed production tubulars are withdrawn utilizing a conventional workover rig. After the jointed tubulars are removed, coiled tubing operations may be performed utilizing a coiled tubing injector and, after such coiled tubing operations are completed, a conventional rig is again utilized to insert jointed tubulars back into the wellbore. To remove and install the jointed tubulars, the conventional workover rig must be transported to the site and set up before commencing coiled tubing operations.

Because it is time-consuming and expensive to set up and remove conventional workover rigs, there is a need for a more time and cost-efficient way to pull jointed tubulars prior to conducting conventional coiled tubing operations. Such a method may also result in the performance of heretofore traditional rig operations with the coiled tubing unit.

SUMMARY OF THE INVENTION

This invention provides an apparatus for injecting and/or withdrawing jointed tubulars from a wellbore. The invention comprises a coiled tubing injector with a lift sub disposed therein positioned over a wellbore. As is well known in the art, coiled tubing injectors include conveyor means, for instance opposed gripper chains, and drive means, for instance reversible hydraulic motors, to drive the gripper chains. Typically, the gripper chains engage coiled or reeled tubing, and the drive means causes the gripper chain to move to withdraw or inject such coiled tubing, depending on the direction of movement of the chains. With the present invention, a lift sub is disposed in the tubing injector between the gripper chains and is utilized to withdraw and/or insert jointed tubulars from the wellbore.

The lift sub of the present invention may comprise a substantially cylindrical rod, or tubing, having an upper end and a lower end. A connecting means for connecting the lift sub to an upper end of a jointed tubular extending out of a wellbore is disposed at the lower end of the lift sub.

The tubing injector is mounted on a support structure above the wellbore. When jointed tubulars are to be removed from the wellbore, the lift sub is lowered so that it can be connected with the connecting means to the jointed tubulars extending from the wellbore. The connecting means may include a hook connected to the lower end of the lift sub, and an elevator connected to the hook. The hook may be threadedly connected to the lower end of the lift sub.

As is well known in the art, the elevator can be closed around the jointed tubular extending from the wellbore, so that the tubing injector can be actuated to pull the lift sub and the jointed tubular upward to remove the jointed tubular from the wellbore. Once one jointed tubular, which may also be referred to as a joint or stand, has been withdrawn from the wellbore, the operator will shut off the coiled tubing injector. The string of jointed tubulars being removed from the wellbore is held in place at the wellhead with a typical bowl and slips. The jointed tubular or stand that has been withdrawn from the wellbore can then be disconnected from the string of jointed tubulars by unthreading in any manner known in the art. Once the withdrawn jointed tubular has been removed and stored, the lift sub can be lowered to connect to the jointed tubular extending above the wellbore and held by the bowl and slips.

When the lift sub is in an upper operating position, wherein a jointed tubular is being unthreaded for removal or threaded for insertion, the lift sub will extend a distance upwardly above the tubing injector. A support means for the lift sub is therefore included and is mounted on the support structure. The support means stabilizes the lift sub when it extends upwardly above the tubing injector. The invention may also include limiting means to limit the maximum amount of travel of the lift sub.

The limiting means includes a limit switch or limit device positioned above the conveyor means and a limit switch or limit device positioned below the conveyor means. The lift sub has outwardly extending shoulders disposed thereon near the upper and lower ends thereof. The limit switches are operably associated with the drive means so that if the tubing injector lowers the lift sub until the upper shoulder defined thereon engages the upper limit switch, the drive means automatically stops to prevent any further downward movement. Likewise, if the tubing injector raises the lift sub until the lower shoulder defined thereon engages the lower limit switch, the drive means automatically stops to prevent any further upward movement. The limiting means is a safety device which will prevent damage to the lift sub and the coiled tubing injector in the event that the operator fails to stop the movement of the lift sub.

It is thus an object of this invention to eliminate, or at least alleviate the need to use a conventional rig to remove jointed tubulars prior to conducting coiled tubing operations. It is a further object of this invention to provide an apparatus which will inject and/or withdraw jointed tubulars from a wellbore.

BRIEF DESCRIPTION OF THE DRAWINGS

FIG. 5 is a view from line 5—5 in FIG. 4 and schematically shows the tubing injector with the hydraulic motor attached thereto.

FIG. 7 is a perspective of the upper portion of an upright support of the present invention.

FIG. 9 schematically shows a perspective view of the stabilizing means attached to the top of the support structure. The super structure for the coiled tubing injector is shown schematically with the lift sub of the present invention extending thereabove.

DETAILED DESCRIPTION OF A PREFERRED EMBODIMENT

Figure 1:
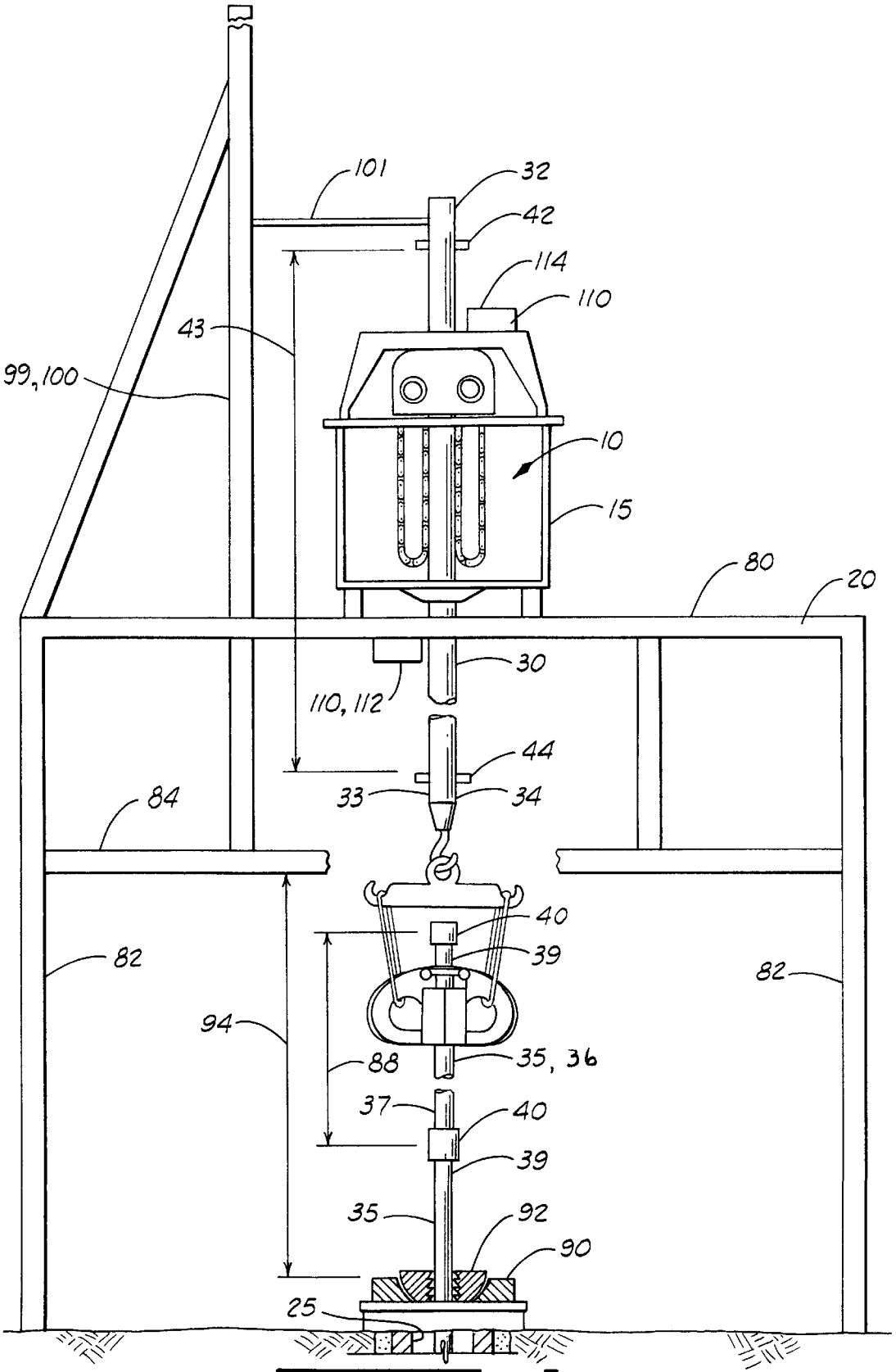
FIG. 1 is a schematic of a lift sub of the present invention disposed in a coiled tubing injector and connected to a jointed tubular extending from a wellbore.

Referring now to the drawings and more particularly to FIG. 1, a coiled tubing injector 10 mounted in a superstructure 15 is schematically shown mounted on a support structure 20. The coiled tubing injector 10 is positioned above a wellbore 25. A lift sub 30 having an upper end 32, an outer surface, or outer diameter 33 and a lower end 34 is disposed in coiled tubing injector 10 and is connected at lower end 34 to a jointed tubular 35 extending from wellbore 25. As shown schematically in FIG. 1, jointed tubular 35 is part of a string 36 of jointed tubulars 35. Each jointed tubular 35, which may be referred to as a joint or a stand, has a lower end 37 and an upper end 39. The jointed tubulars in the string 36 are connected to each other by couplings 40 at the upper and lower ends thereof. The upper end 39 of the uppermost jointed tubular in the string 36 comprises the upper end of the string 36 of jointed tubulars extending from wellbore 25. Lift sub 30 has an upper, or first shoulder 42 disposed on outer surface 33. Upper shoulder 42 extends outwardly from outer surface 33 near upper end 32 of lift sub 30. Lift sub 30 also includes a lower, or second shoulder 44 disposed thereon, which extends outwardly from outer surface 33 near lower end 34 of lift sub 30.

Figure 2:
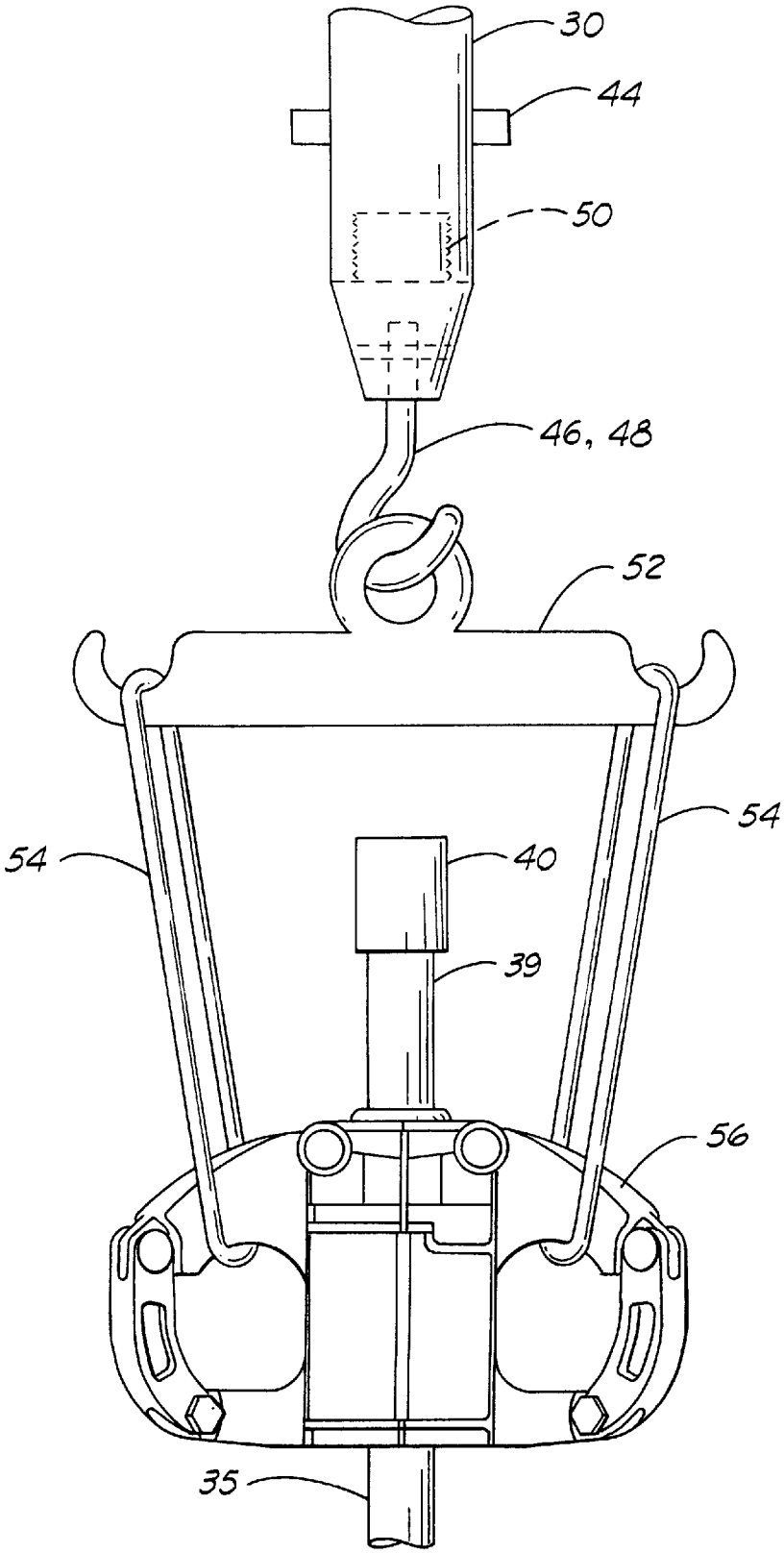
FIG. 2 shows a lower end of a lift sub and the connection to a jointed tubular.
Figure 3:
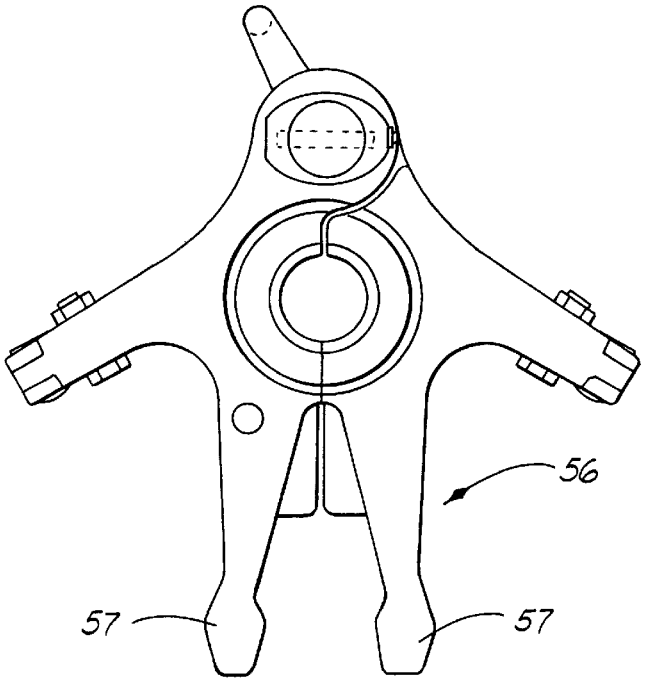
FIG. 3 shows a top plan view of an elevator.

A connecting means 46 is attached to lift sub 30 at the lower end 34 thereof. Connecting means 46, as more clearly seen in FIG. 2, may include a multi-purpose hook 48 adapted to be connected to lift sub 30. Lift sub 30 may thus have threads 50 defined in the lower end thereof so that hook 48 is threadedly connected thereto. Hook 48 may be attached to a load spreader 52 having lift nubbins 54 hanging downward therefrom and connected to an elevator 56. Load spreader 52, lift nubbins 54 and elevator 56 are known in the art. A top view of elevator 56 is shown in FIG. 3. As is well known, elevator 56 has handles 57 which are utilized to open and close the elevator. In FIG. 2, the uppermost jointed tubular 35 is shown disposed in elevator 56 while the elevator is in its closed position, thus connecting lift sub 30 to jointed tubular 35 such that vertical movement of lift sub 30 will cause jointed tubular 35, and the string 36 of jointed tubulars therebelow to move vertically. The outer diameter 33 may vary depending on the size of injector 10, and is preferably in a range from approximately 1.25 inches to approximately 4.0 inches. Lift sub 30 has a length 43 between shoulders 42 and 44 which, as described more fully herein, is sufficient to allow at least one jointed tubular to be completely withdrawn from wellbore 25 with ample clearance to disconnect and remove the withdrawn tubular 35.

Figure 4:
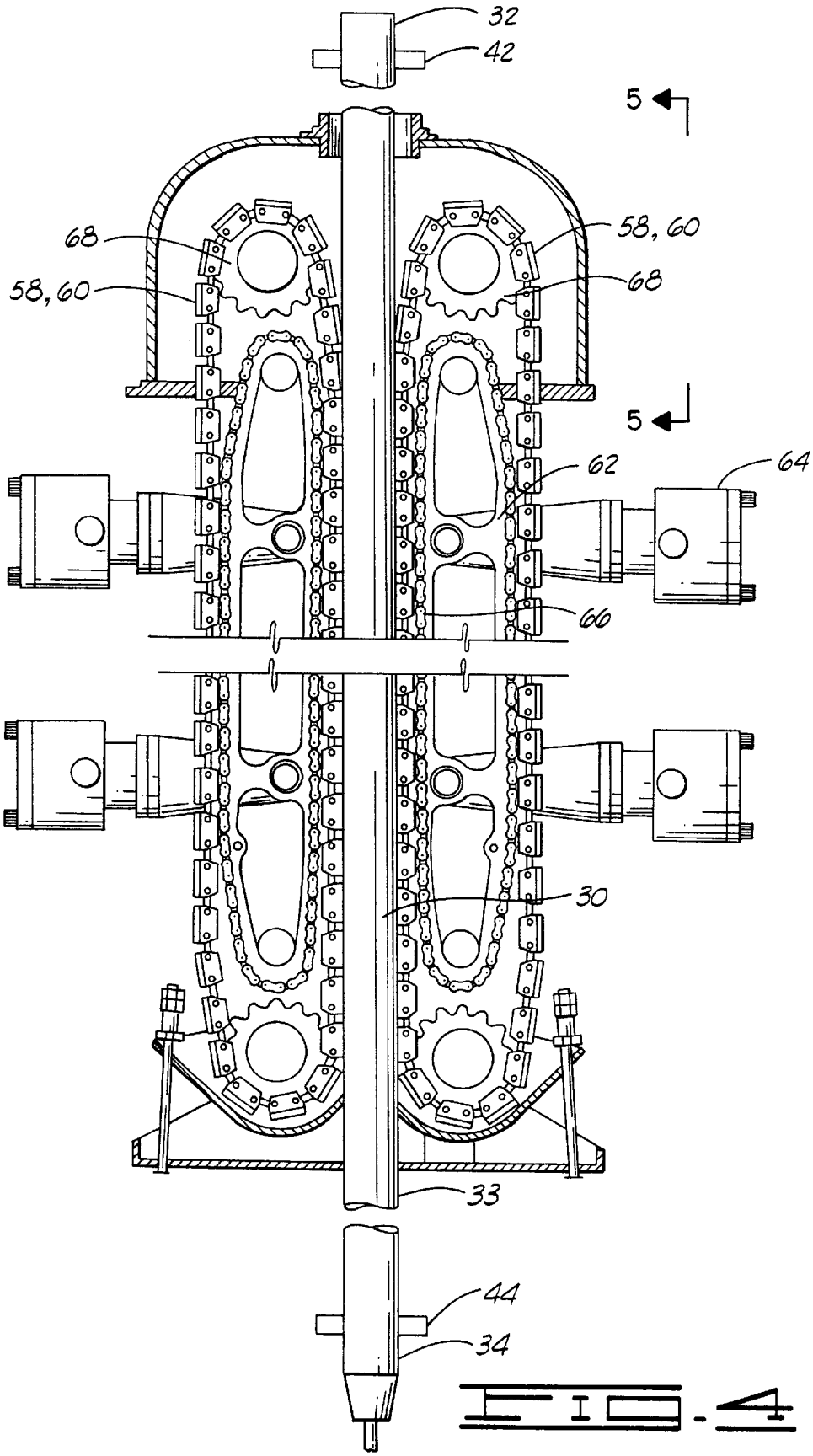
FIG. 4 is a schematic view showing a coiled tubing injector with a portion of the lift sub of the present invention gripped between the drive chains thereof.
Figure 8:
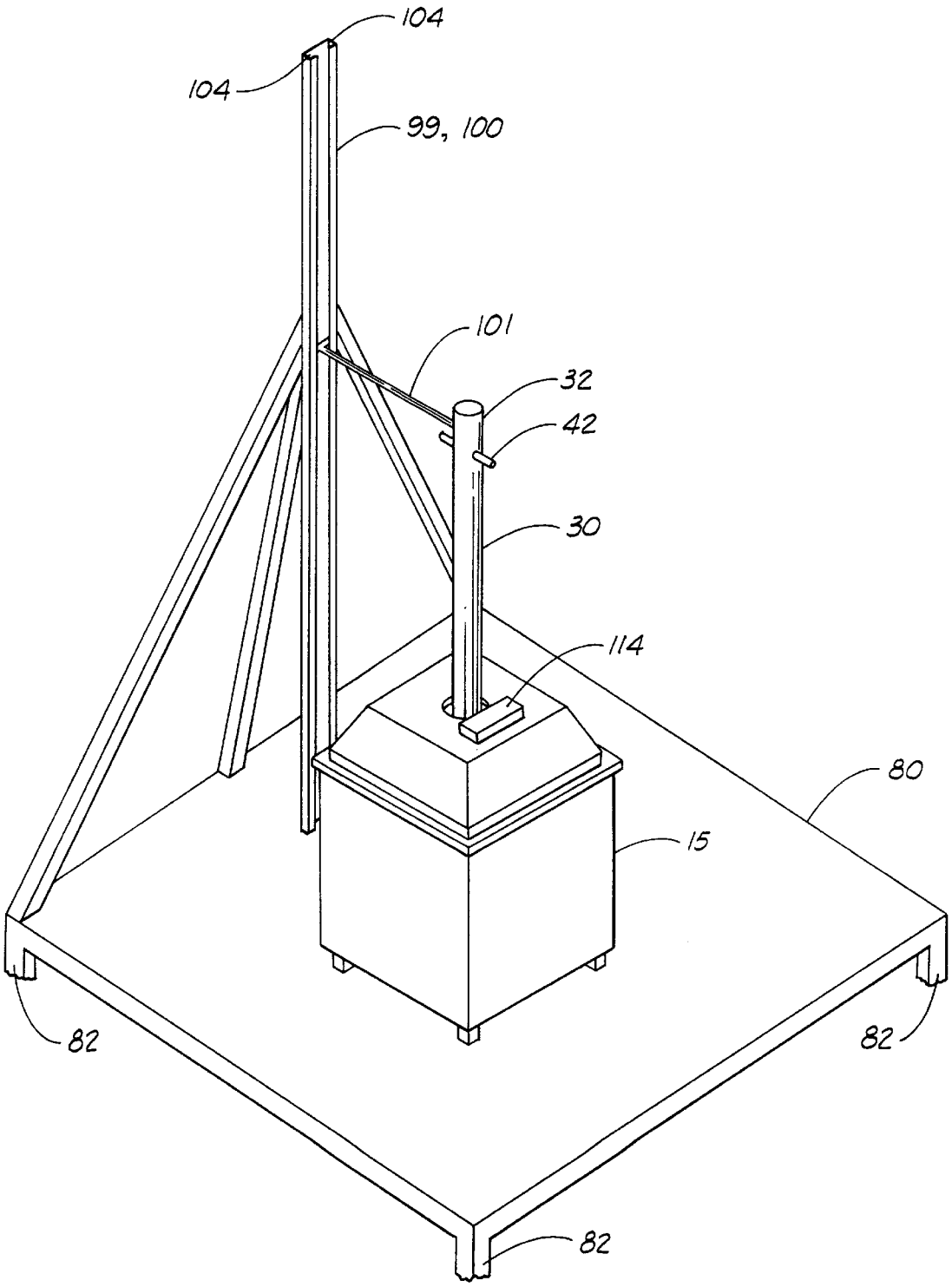
FIG. 8 is a perspective of a guide arm of the present invention.

Coiled tubing injector 10 is of a type well known in the art and may include coiled tubing injector sizes from 30K to 100K depending upon the capacity needed to withdraw or inject jointed tubulars. A number of patents have been issued relating to reeled or coiled tubing injectors including U.S. Pat. No. 2,679,924 issued Jun. 1, 1954, U.S. Pat. No. 3,258,110 issued Jun. 28, 1966, U.S. Pat. No. 3,285,485 issued Nov. 15, 1966, U.S. Pat. No. 3,559,905 issued Feb. 2, 1971, U.S. Pat. No. 3,754,474 issued Aug. 28, 1973, U.S. Pat. No. 4,515,220 issued May 7, 1985, U.S. Pat. No. 4,655,291 issued Apr. 7, 1987, U.S. Pat. No. 5,094,340 issued Mar. 10, 1992, the details of all of which are incorporated herein by reference for all purposes. A coiled injector which can be used in conjunction with the present invention is schematically shown in FIG. 4 with a lift sub 30 disposed therein.

Coiled tubing injector 10 includes conveyor means, which may comprise endless opposed drive or gripper chains 58 each carrying a multiplicity of gripper blocks 60. The gripper blocks engage and press against lift sub 30 by hydraulic cylinders 64 biasing pressure beams 62 inwardly. A roller chain 66 is interposed between the pressure beams 62 and drive chains 58 to reduce friction therebetween. Gripper chains 58 are driven by sprockets 68 which are powered by drive means 69, such as reversible hydraulic motors 70 as schematically shown in FIG. 5. As shown in FIG. 4, gripper chains 58 will engage the sides of lift sub 30, and hydraulic motors 70 will rotate sprockets 68 in a desired direction to move lift sub 30 vertically either upwardly or downwardly. Injector 10 is operated in a typical manner by an operator who will actuate the hydraulic motors to drive the sprockets and thus move the lift sub up or down, and who will shut the motor off so that a jointed tubular can be disconnected from or connected to the lift sub. The motor may be of any type known in the art, and may be driven by a planetary gear and include integral brakes, so that the motor can be actuated to inject and/or withdraw jointed tubulars and may be shut off, or stopped, to stop the movement of the lift sub and a jointed tubular connected thereto.

Referring now to the schematic shown in FIG. 1, support structure 20 includes a first work platform 80 disposed upon a plurality of legs 82. The support structure must have enough structural integrity to support not only the weight of tubing injector 10 but also to support the load that will be applied by the weight of the jointed tubulars being removed or injected into the wellbore. Support structure 20 also includes a second or lower platform 84 positioned below first work platform 80. FIG. 1 also schematically shows a typical arrangement at the wellhead which includes a bowl 90 and slips 92. Platform 84 is positioned a distance 94 above bowl 90 and slips 92 so that a jointed tubular 35 having a length 88 will be completely withdrawn from the wellbore and located entirely above slips 92 when elevator 56 is positioned so that the elevator 56 can be manually operated by an operator on platform 84. Thus, the distance 94 between platform 84 and slips 92 provides an ample amount of clearance for a jointed tubular 35.

To remove jointed tubulars, elevator 56 will be connected to jointed tubular 35 at the wellhead, above slips 92 which will hold the jointed tubular in place. Elevator 56 can be connected to jointed tubular 35 near the upper end 39 thereof, below coupling 40. Drive means 69, such as hydraulic motors 70, can then be actuated so that opposed drive chains 58, which engage lift sub 30, will raise lift sub 30 and pull jointed tubular 35 from the wellbore. The hydraulic motor is actuated manually by an operator who can turn the motor on and off and can reverse the direction of the drive chains so that the lift sub, and thus the jointed tubular connected thereto can be moved up or down any desired amount. The lift sub 30 may be raised until elevator 56 is positioned adjacent second platform 84. Once the jointed tubular has been raised a sufficient amount, it can be disconnected from the string 36 of jointed tubulars in the wellbore by an operator on platform 84 by any manner known in the art with tongs or any other standard equipment known in the art. After the jointed tubular has been disconnected, the elevator can be opened by the operator at work platform 84 and the removed jointed tubular 35 may be stored in a rack or other storage apparatus.

Once a jointed tubular 35 has been removed, lift sub 30 can be lowered by tubing injector 10 so that elevator 56 can be connected to another jointed tubular 35 extending from the wellbore. Any number of jointed tubulars can be removed from the wellbore in this fashion until a desired number of tubulars have been removed, which may be the entire string 36 of jointed tubulars in the wellbore, so that coiled tubing operations can be performed.

If it is desired that the apparatus be utilized to inject jointed tubulars the process can simply be reversed. In other words, an operator at work platform 84 may close elevator 56 around a jointed tubular 35 and the coiled tubing injector 10 can be actuated to lower the jointed tubular into the wellbore. Once the jointed tubular has been lowered so that the upper end 39 thereof is positioned above bowl 90 and slips 92, the bowl and slips will engage jointed tubular 35 to hold it in place and elevator 56 can be released. Lift sub 30 will then be raised by tubing injector 10 and another jointed tubular 35 can be positioned in elevator 56 by operators on work platform 84. Tongs or other means can then be used to threadedly connect lower end 37 of a jointed tubular 35 to the coupling 40 at the upper end 39 of the jointed tubular 35 extending upward from and held in place by the bowl 90 and slips 92. Once the threaded connection is made, tubing injector 10 can be actuated to lower lift sub 30 and jointed tubulars 35 into the wellbore. The process can be repeated continually until a desired number of jointed tubulars 35 have been injected into the wellbore.

As seen in FIG. 1, a stabilizing means 99, which may include an upright support 100 is mounted to the upper platform 80. Upright support 100 may have a substantially C-shaped cross section as shown in FIGS. 7 and 9, and thus may include travel slots or grooves 104. A guide arm 101 is received in slots 104 of upright support 100 and extends therefrom. Guide arm 101 is connected to the lift sub 30 near the upper end 32 thereof. Guide arm 101 moves vertically with lift sub 30 so that as lift sub 30 moves, guide arm 101 will hold and stabilize lift sub 30.

Guide arm 101 may comprise a T-shaped guide arm having a straight portion 102 and a tee section 103. Straight section 102 has a first end 106 and a second end 108. Second end 108 is connected to tee section 103. First end 106 is rigidly connected to lift sub 30 by threading, welding, or any other means known in the art. Tee section 103 has opposed ends 105. Each of opposed ends 105 may have a roller, such as, but not limited to, a Teflons roller 107 disposed at opposed ends 105. Rollers 107 may be received in opposed grooves 104 defined by C-shaped support 100. Thus, as lift sub 30 moves up and down, guide arm 101 moves up and down along C-shaped support 100. Because it is rigidly attached to lift sub 30, guide arm 101 will stabilize lift sub 30 when lift sub 30 extends a distance above the coiled tubing injector 10. Support 100 has a height above platform 20 sufficient to allow a full stroke of lift sub 30. In other words, support 100 will be tall enough so that guide arm 101 will stay in grooves 104 when lift sub 30 is moved a sufficient amount to completely remove a jointed tubular from the wellbore.

The apparatus further includes a limiting means 110, which is a safety device that will automatically stop the movement of lift sub 30. Limiting means 110 thus limits the vertical travel of the lift sub. Limiting means 110 may include an upper or first limit switch 114 mounted on superstructure 15 above drive chains 58 and a lower or second limit switch 112 mounted below drive chains 58. Upper limit switch 114 is operably associated with drive means 69 and is engagable with upper shoulder 42 defined on lift sub 30 so that when lift sub 30 is lowered, upper shoulder 42 will engage upper limit switch 114 in the event the tubing injector operator fails to stop the movement of the lift sub. Limit switch 114 is operably associated with the drive means such that when upper shoulder 42 engages upper limit switch 114 drive means 69 automatically shuts off thereby automatically stopping the downward movement of the lift sub. Likewise, lower limit switch 112 is operably associated with drive means 69 and is engagable with lower shoulder 44 such that drive means 69 will automatically shut off when lower shoulder 44 engages limit switch 112 thereby automatically stopping the upward movement of lift sub 30.

Limit switches 112 and 114 may be hydraulic or electric switches. In both cases, contact to either the upper or lower limit switch by the corresponding shoulder will cause diversion of hydraulic fluid away from the hydraulic motors, thus stopping movement of the sprockets 68 and drive chains 58. A manual override will be included to allow resetting of the switches to recommence lifting or lowering operations.

The method of operation, as is obvious from the description set forth herein, is as follows. When it is desired to remove jointed tubulars 35, coiled tubing injector 10 is actuated to lower lift sub 30 and elevator 56. An operator at the wellhead can manually open the elevator and close the elevator around a jointed tubular 35 extending out of the wellbore below coupling 40. The injector operator can then actuate tubing injector 10 so that it raises lift sub 30 and elevator 56 until elevator 56 is positioned adjacent platform 84. When elevator 56 reaches this position, which may be referred to as an upper operating position, the withdrawn jointed tubular 35 will be completely clear of the bowl 90 and slips 92. The jointed tubular 35 immediately below the withdrawn jointed tubular will extend a sufficient distance above the slips 92 so that elevator 56 can be lowered and connected thereto after the withdrawn jointed tubular has been removed.

Once elevator 56 reaches platform 84, coiled tubing injector 10 is shut off to stop the movement of the lift sub 30. The slips 92 will engage and hold the jointed tubular immediately below the withdrawn tubular, and tongs or other standard equipment can be utilized to disconnect the withdrawn jointed tubular 35. Once the jointed tubular 35 has been unthreaded from the coupling 40 therebelow, the operator can open the elevators and the withdrawn jointed tubular 35 can be placed in a rack or other storage apparatus. Lift sub 30 and elevator 56 can then be lowered and the process repeated as often as is required to remove as many jointed tubulars 35 as desired from the wellbore. If it is desired to inject jointed tubulars into the wellbore utilizing the apparatus of the present invention, the process may simply be repeated.

In other words, lift sub 30 may be raised so that the elevator is positioned adjacent work platform 84, and a jointed tubular may be positioned utilizing standard equipment so that the elevator can be placed below a coupling at the upper end of the jointed tubular to be inserted. Once elevator 56 is closed, tubing injector 10 is actuated to insert the jointed tubular 35 into the wellbore. When elevator 56 reaches a position near the slips, tubing injector 10 is shut off and slips 92 engage and hold in place the jointed tubular 35 that has been inserted. Slips 92 will grasp the jointed tubular 35 being inserted below the coupling 40. This process can be repeated until any number of joints have been inserted into the wellbore. The operator may then open elevator 56 and coiled tubing injector 10 is actuated to pull lift sub 30 upwardly until elevator 56 once again is adjacent platform 84. An additional jointed tubular 35 can then be placed into the elevator and threadedly connected to the coupling 40 located above slips 92. Coiled tubing injector 10 can then be actuated to lower the jointed tubulars 35 into the wellbore.

Figure 6A:
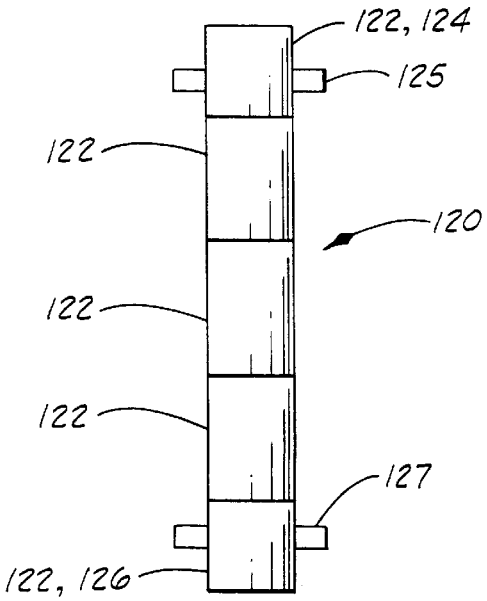
FIGS. 6A and 6B show alternative embodiments of the lift sub of the present invention.
Figure 6B:
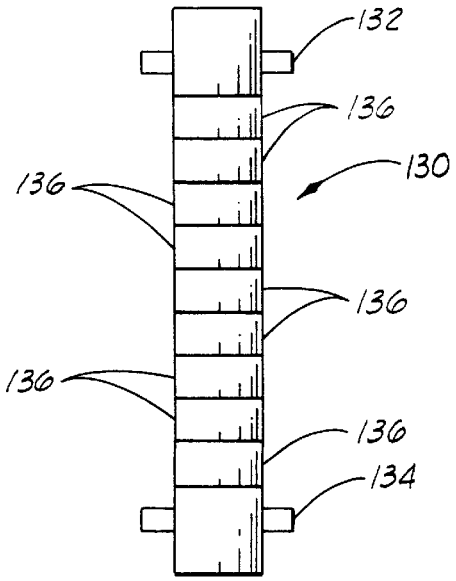

Although the lift sub of the invention has been described herein with reference to a solid rod or a cylindrical piece of tubing, FIGS. 6A and 6B show alternative embodiments of the lift sub. FIG. 6A shows a lift sub 120 having a plurality of threaded joints 122 threadedly connected to one another. Threaded joints 122 include an upper threaded joint 124 which has an upper shoulder 125 defined thereon and a lower threaded joint 126 which has a lower shoulder 127 defined thereon. FIG. 6B shows a segmented lift sub 130 having an upper shoulder 132 and a lower shoulder 134 defined thereon. Segmented lift sub 130 comprises a plurality of segments 136 and is flexible so that a stabilizing means is not necessary. In other words, when lift sub 130 is being raised, the portion of the lift sub extending above coiled tubing injector 10 will flex and bend over thereby eliminating the need for a stabilizing means.

The lift sub of the present invention thus provides a time and cost-effective way to remove and insert jointed tubulars when coiled tubing operations are to be performed. Rather than setting up conventional rigs to remove jointed tubulars prior to conducting coiled tubing operations and then once again setting up the conventional rig to reinsert jointed tubulars after coiled tubing operations are complete, a coiled tubing injector can be utilized with the lift sub of the present invention to pull and remove jointed tubulars. The tubing injector can also be utilized to perform coiled tubing operations and after coiled tubing operations are complete can be utilized in conjunction with the lift sub to reinsert jointed tubulars into the wellbore.

Thus, it is seen that the apparatus of the present invention readily achieves the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. Apparatus for injecting jointed tubulars into a wellbore or removing jointed tubulars therefrom comprising:

a tubing injector positioned above said wellbore;

a lift sub disposed in said tubing injector, said lift sub having an upper end and a lower end, said tubing injector having a pair of spaced-apart conveyor members for engaging said lift sub, and having a drive means for driving said conveyor members to move said lift sub upwardly and downwardly to inject or withdraw said jointed tubulars, said drive means being switchable between an operating position wherein said conveyor members move said lift sub and a stop position wherein said conveyor members stop said lift sub;

connecting means attached to said lower end of said lift sub for connecting said lift sub to said jointed tubulars;

an upper shoulder defined on said lift sub, said upper shoulder being positioned above said conveyor members;

a lower shoulder defined on said lift sub, said lower shoulder being positioned below said conveyor members;

an upper limit switch positioned above said conveyor members, said upper limit switch being operably associated with said drive means and engagable with said upper shoulder, wherein said drive means automatically moves to said stop position when said upper shoulder engages said upper limit switch thereby stopping downward movement of said lift sub; and a lower limit switch positioned below said conveyor members, said lower limit switch being operably associated with said drive means and engagable with said lower shoulder, wherein said drive means automatically moves to said stop position when said lower shoulder engages said lower limit switch, thereby stopping upward movement of said lift sub.

2. The apparatus of claim 1, wherein said lift sub is a substantially cylindrical rigid member.

3. The apparatus of claim 1 wherein said lift sub is flexible.

4. The apparatus of claim 1 wherein said connecting means comprises:

a hook member connected to said lower end of said lift sub, said hook member including a hook extending downwardly therefrom, said hook being attached to an elevator adapted to connect to said jointed tubular.

5. The apparatus of claim 1 further comprising stabilizing means for stabilizing said lift sub when said lift sub extends above said tubing injector.

6. The apparatus of claim 1 wherein said drive means comprises a hydraulic motor.

7. Apparatus for injecting jointed tubulars in and removing jointed tubulars from a wellbore comprising:

a tubing injector positioned above said wellbore;

a lift sub disposed in said tubing injector, said lift sub having an upper end and a lower end, said tubing injector having a pair of conveyor members for engaging said lift sub having a drive means switchable from an operating position and a stop position, wherein in said operating position said drive means moves said conveyor members so that said conveyor members move said lift sub upwardly or downwardly, and wherein said conveyor members are stationary when said drive means is in said stop position so that said lift sub is stationary;

connecting means for connecting said lift sub to said jointed tubulars;

limiting means operably associated with said drive means, wherein said limiting means automatically switches said drive means to said stop position to stop the movement of said conveyor members, thereby stopping the movement of said lift sub, when said lift sub reaches a preselected position.

8. The apparatus of claim 7, wherein said preselected position comprises an uppermost desired position of said lift sub.

9. The apparatus of claim 7, wherein said preselected position comprises a lowermost desired position of said lift sub.

10. The apparatus of claim 7, said limiting means comprising first and second limit switches operably associated with said drive means, wherein said first limit switch causes said drive means to move to said stop position when said lift sub reaches a lowermost desired position, and wherein said second limit switch causes said drive means to move to said stop position when said lift sub reaches an uppermost desired position.

11. The apparatus of claim 7 further comprising:

an upper shoulder defined on said lift sub, said upper shoulder being positioned above said conveyor members;

a lower shoulder defined on said lift sub, said lower shoulder being positioned below said conveyor members;

an upper limit switch positioned above said conveyor members, said limit switch being operably associated with said drive means and engagable with said upper shoulder, wherein said drive means automatically moves to said stop position when said upper shoulder engages said upper limit switch thereby stopping downward movement of said lift sub; and a lower limit switch positioned below said conveyor members, said lower limit switch being operably associated with said drive means and engagable with said lower shoulder, wherein said drive means automatically moves to said stop position when said lower shoulder engages said lower limit switch, thereby stopping upward movement of said lift sub.

12. The apparatus of claim 7, said drive means comprising a hydraulic motor.

13. The apparatus of claim 7, wherein said tubing injector is mounted on a work platform positioned over said wellbore.

14. The apparatus of claim 13 further comprising a support mounted on said work platform for stabilizing said lift sub.

15. Apparatus for injecting jointed tubulars into a wellbore or removing jointed tubulars therefrom comprising:

a tubing injector positioned above said wellbore;

a lift sub disposed in said tubing injector, said lift sub having an upper end and a lower end;

connecting means attached to said lower end of said lift sub for connecting said lift sub to said jointed tubulars;

a support structure positioned over said wellbore, said tubing injector being mounted on said support structure; and a stabilizing means for stabilizing said lift sub when said lift sub extends above said tubing injector, said stabilizing means comprising:

an upright support mounted to said support structure; and a guide arm extending outward from said upright support and connected to said lift sub, said guide arm being movable along a length of said upright support so that said guide arm moves upwardly and downwardly with said lift sub.

16. The apparatus of claim 15, further comprising limiting means for limiting the vertical movement of said lift sub.

17. The apparatus of claim 15, said tubing injector having a pair of spaced-apart conveyor members for engaging said lift sub and having a drive means for driving said conveyor members to move said lift sub upwardly and downwardly to inject or withdraw said jointed tubulars, said drive means being switchable between an operating position wherein said conveyor members move said lift sub and a stop position wherein said conveyor members stop said lift sub.

18. The apparatus of claim 15, wherein said lift sub is a substantially cylindrical rigid member.

19. The apparatus of claim 15 wherein said connecting means comprises:

a hook member connected to said lower end of said lift sub, said hook member including a hook extending downwardly therefrom, said hook being attached to an elevator adapted to connect to said jointed tubular.

* * * * *